US010814655B2

(12) United States Patent
Brasil

(10) Patent No.: US 10,814,655 B2
(45) Date of Patent: Oct. 27, 2020

(54) CABINET CONFIGURATION

(71) Applicant: SICPA HOLDING SA, Prilly (CH)

(72) Inventor: Eduardo Brasil, Rio de Janeiro (BR)

(73) Assignee: SICPA HOLDINGS SA, Prilly (CH)

( * ) Notice: Subject to any disclaimer, the term of this patent is extended or adjusted under 35 U.S.C. 154(b) by 0 days.

(21) Appl. No.: 16/490,848

(22) PCT Filed: Nov. 17, 2017

(86) PCT No.: PCT/EP2017/079606
§ 371 (c)(1),
(2) Date: Sep. 3, 2019

(87) PCT Pub. No.: WO2018/157956
PCT Pub. Date: Sep. 7, 2018

(65) Prior Publication Data

US 2019/0381817 A1 Dec. 19, 2019

(30) Foreign Application Priority Data

Mar. 3, 2017 (WO) ..... PCT/EP2017/055025

(51) Int. Cl.
*B41J 29/06* (2006.01)
*B41J 29/13* (2006.01)

(52) U.S. Cl.
CPC ..... *B41J 29/06* (2013.01); *B41J 29/13* (2013.01)

(58) Field of Classification Search
CPC ... B41J 29/06; B41J 29/13; A47B 2021/0357; A47B 17/036; A47B 17/065; A47B 46/005
See application file for complete search history.

(56) References Cited

U.S. PATENT DOCUMENTS

| | | | | |
|---|---|---|---|---|
| 850,210 | A * | 4/1907 | Cady | A47B 17/036 312/289 |
| 1,300,780 | A | 4/1919 | Walter | |
| 2,306,166 | A | 12/1942 | Jones et al. | |
| 4,502,742 | A * | 3/1985 | Neff | A47B 53/00 312/321.5 |
| 5,924,781 | A * | 7/1999 | Mitchell | A47B 63/04 312/230 |
| 9,884,490 | B2 * | 2/2018 | Ohba | B41J 29/02 |
| 10,065,414 | B2 * | 9/2018 | Nishiyama | B41J 29/38 |
| 10,071,579 | B2 * | 9/2018 | Aoki | B41J 29/02 |

(Continued)

FOREIGN PATENT DOCUMENTS

| | | |
|---|---|---|
| DE | 8517368 | 8/1985 |
| GB | 2243069 | 10/1991 |

OTHER PUBLICATIONS

International Search Report and Written Opinion dated Mar. 2, 2018 with respect to application No. PCT/EP2017/079606, 10 pages.

(Continued)

*Primary Examiner* — Hanh V Tran
(74) *Attorney, Agent, or Firm* — Muncy, Geissler, Olds & Lowe, P.C.

(57) ABSTRACT

A cabinet configuration for accommodating a printing device. The cabinet configuration may be used in conjunction with a conveying device, in particular a conveying device of a production line, for conveying objects like containers, packages, products, parcels or bottles.

20 Claims, 5 Drawing Sheets

(56) References Cited

U.S. PATENT DOCUMENTS

| | | | | |
|---|---|---|---|---|
| 10,183,495 | B2 * | 1/2019 | Kudo | B41J 2/19 |
| 2003/0042830 | A1 * | 3/2003 | Gregorio | A47B 46/005 312/325 |
| 2007/0211131 | A1 * | 9/2007 | Iijima | B41J 2/1752 347/108 |
| 2010/0231105 | A1 * | 9/2010 | Latif | A47B 46/005 312/293.1 |
| 2013/0099638 | A1 * | 4/2013 | Pala | B41J 29/02 312/223.2 |
| 2013/0175906 | A1 * | 7/2013 | Yen | B41J 29/02 312/34.8 |
| 2014/0085386 | A1 * | 3/2014 | Wei | B41J 2/17596 347/85 |
| 2016/0121615 | A1 * | 5/2016 | Igarashi | B41J 2/175 347/85 |
| 2016/0263904 | A1 * | 9/2016 | Maeshima | B41J 2/17523 |
| 2016/0288512 | A1 * | 10/2016 | Koizumi | B41J 2/17553 |
| 2017/0021633 | A1 * | 1/2017 | Kawate | B41J 2/17513 |
| 2018/0194150 | A1 * | 7/2018 | Smith | B41J 29/13 |
| 2019/0009569 | A1 * | 1/2019 | Kudo | B41J 2/19 |

OTHER PUBLICATIONS

International Preliminary Report on Patentability dated Apr. 3, 2019 with respect to application No. PCT/EP2017/079606, 15 pages.

* cited by examiner

CABINET CONFIGURATION

TECHNICAL FIELD

The present invention refers to a cabinet configuration for accommodating a printing device. The cabinet configuration may be used in conjunction with a conveying device (in particular a conveying device of a production line) for conveying objects like containers, packages, products, parcels or bottles.

BACKGROUND

Cabinet configurations to safely accommodate one or more printing devices are generally known. In certain time intervals, maintenance operations have to be performed, wherefore access to the printing device in the cabinet configuration is required.

During maintenance operation, the printing device has to be extracted from the cabinet configuration, or the printing device has to be repositioned so as to provide access to a rear portion thereof. In these situations, the staff working performing the maintenance operation has to take care of cables or the like and avoid any damage thereof. Due to the weight of a printing device or printing devices located in the cabinet configuration, maintenance operations may be difficult and demand a high degree of attention.

SUMMARY OF THE INVENTION

An object of the present invention is to provide a cabinet configuration for accommodating a printing device (printer) with enhanced handling and maintenance features.

The present invention provides a cabinet configuration comprising the features of claim 1. Further preferred embodiments are outlined in the dependent claims and/or the following description.

The cabinet configuration according to claim 1 comprises a printer module with a casing, the casing comprising an opening for introducing and/or extracting the printing device. A support element for supporting the printing device is movably connected to an inner portion of the casing so that the support element is at least partially extractable from the casing.

The cabinet configuration according to the present invention improves the accessibility, ease and efficiency of handling and/or maintenance aspects, in particular safety during maintenance, since the support element is at least partially extractable from the casing. Preferably, the support element is a rotatable table.

As a further advantage, twisting of cables of a printer located in the cabinet configuration can be avoided, and if more than one printer is arranged in the cabinet configuration, any collision between different printers is prevented, which is in particular useful for maintenance operations.

According to another aspect, a modular structure is provided, which enhances the flexibility of the cabinet configuration.

In a preferred embodiment, the support element is rotatable relative to the casing, in particular the bottom portion of the casing, preferably around a vertical axis. The operator, may, therefore, turn the support element, thereby providing access to a rear side of the printing device.

The rotation of the support element is in particular around an eccentric axis thereof. Consequently, a portion of the support element can be extracted from the casing.

Preferably, a shaft, which is preferably mounted on the bottom portion, supports the support element, the shaft being in engagement with a bushing. According to a preferred embodiment, the bushing is mounted in a holding member of a lower portion of the support element.

According to another configuration, the support element comprises an upper portion and a lower portion, the upper portion and the lower portion being spaced apart with a gap therebetween. Consequently, the lower portion may provide a structure for connecting the support element to the casing, and the upper portion may provide a configuration for securing the printing device to the support element.

Preferably, a tray is provided in the gap between the upper portion and the lower portion, the tray being at least partially extractable from the gap. The tray may retain possible ink leaks from the printing device. When extracted, the tray may be cleaned in a convenient manner.

In a preferred embodiment, the printer module comprises a door for opening/closing the opening of the casing, the door being preferably movable around a vertical axis.

According to yet another embodiment, an electric module mountable on an upper or lower side of the printer module is provided, the electric module having a housing for accommodating a programmable logic controller. Having an electric module according to this aspect provides a modular structure of the cabinet configuration.

Preferably, the cabinet configuration further comprises a top cover module mountable on an upper portion of the printer module, the top cover module comprising a light element at least partially surrounding the top cover module. The light of the light element may be directed to the interior or exterior of the cabinet configuration, thereby enhancing the working environment for any maintenance operation.

According to a preferred embodiment, the top cover module comprises a lower cover body and an upper cover body, the light element being disposed at or in a groove formed by the lower or upper cover body. The light element is, therefore, securely incorporated in the top cover body.

Preferably, the light element comprises a LED element, like a 24VVC led band, wherein it is preferred that the LED element is configured to provide different colors.

In another embodiment, the cabinet configuration comprises a base module, the base module having feet (in particular four feet) including a post and a stabilizer foot, respectively. Preferably, the stabilizer foot is eccentrically mounted to the post and rotatable relatively to the post. Therefore, the feet may be adjusted in view of a specific environment and in accordance with specific conditions.

According to a particular modification, the post and the stabilizer foot are engaged with each other by an external thread and an internal thread. Consequently, the height may be easily adjusted.

Further, the base module may be insulated from dust and/or water.

In a preferred embodiment, a brake element configured to control the level of effort for moving, in particular turning, the support element is provided. The effort may, therefore, be adjusted as required.

The brake element may comprise a brake which may be pressed against the holding member of the support element, wherein the holding member preferably accommodates the bushing of the support element.

The brake element, and in particular the position of a brake of the brake element relatively to a portion of the support element, may be adjusted manually or via a motor.

The present invention also provides a method for handling a printing device, the printing device being supported by a support element, the support element being located in a casing of a cabinet configuration. The method comprises the following steps: Extracting at least a portion of the support element from the casing, in particular by turning the support element, preferably around a vertical axis, and performing a maintenance operation on the printing device.

The method of the present invention improves the accessibility, ease and efficiency of handling of a printing device accommodated in a cabinet configuration. Any of the above mentioned aspects of the cabinet configuration may be implemented in the method according to the present invention.

BRIEF DESCRIPTION OF THE DRAWINGS

The invention may be better understood by reference to the following specification taken in conjunction with the following drawings.

DETAILED DESCRIPTION OF THE PREFERRED EMBODIMENTS

A preferred embodiment of the present invention is hereafter described in further detail. The description and the accompanying drawings are to be construed by ways of example and not of limitation. For example, modifications of specific elements of the preferred embodiment described hereafter may be combined with other modifications so as to provide further embodiments of the present invention.

The preferred embodiment refers to a cabinet configuration 1 comprising a modular structure with several module or units detachably connected to each other.

Figure 1:
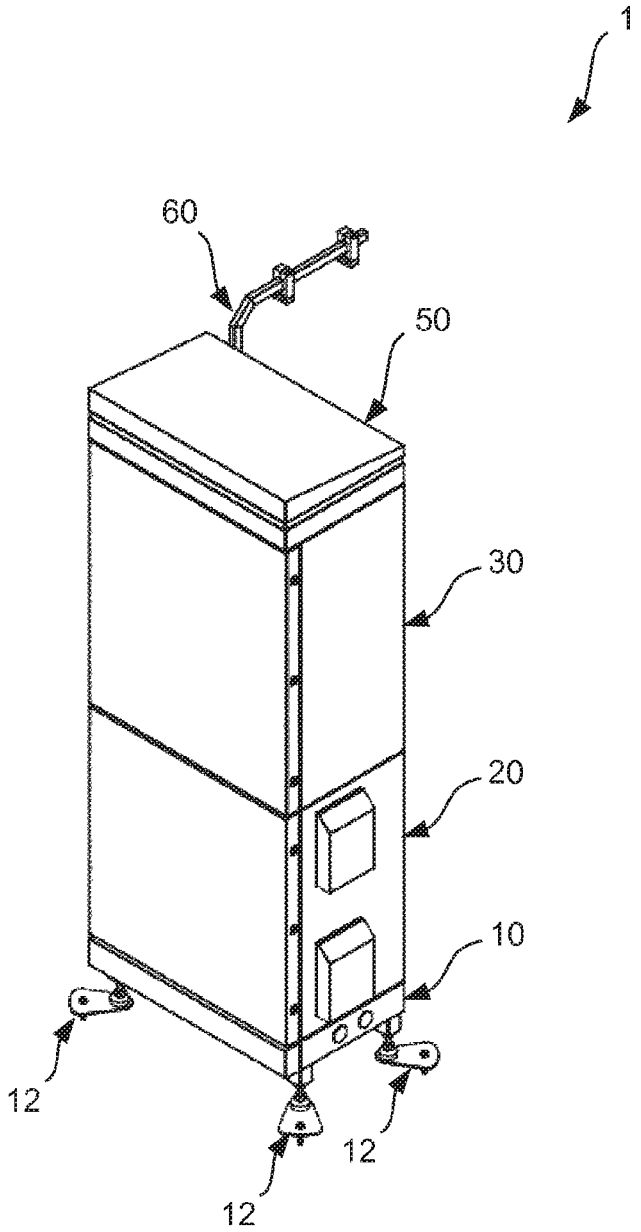
FIG. 1 shows a preferred embodiment of a cabinet configuration of present invention.

In particular, the cabinet configuration 1 includes, according to a configuration shown in FIG. 1, a base module 10 at the vertically lower side of the cabinet configuration 1, an electric module 20 mounted on the base module 10, a printer module 30 mounted on the electric module 20 and a top cover module 50 mounted on the printer module 30. An arm extensor 60 is attached to a backside of the printer module 30.

Figure 3:
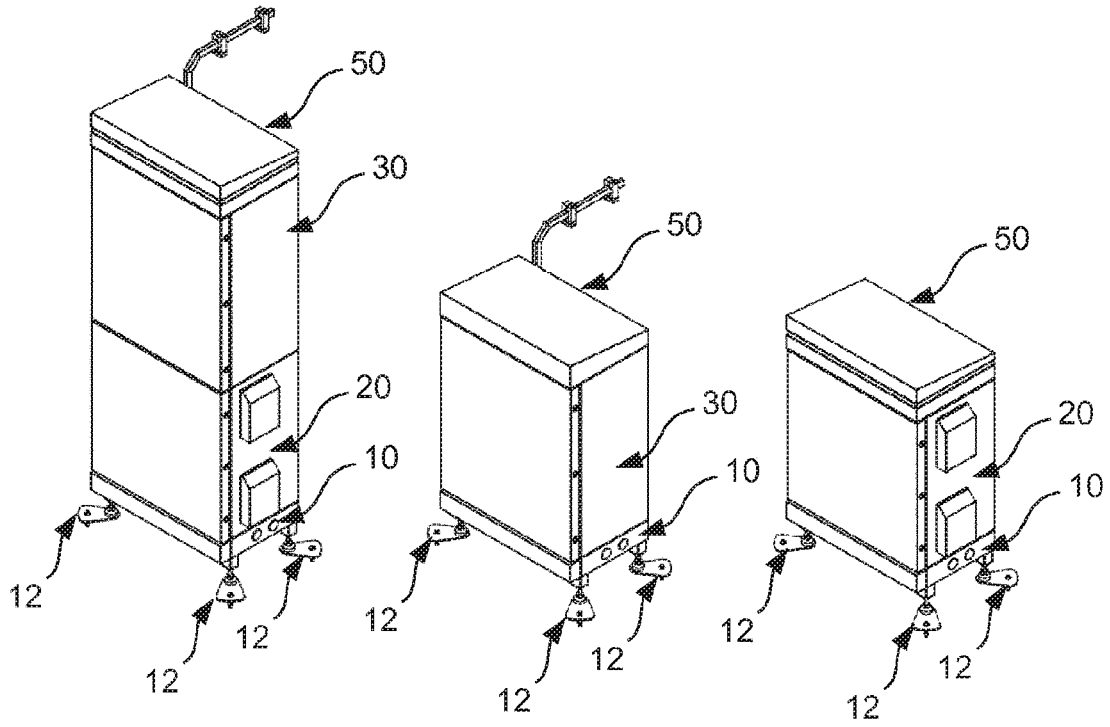
FIG. 3 illustrates several configurations of the cabinet configuration according to the preferred embodiment.
Figure 4:
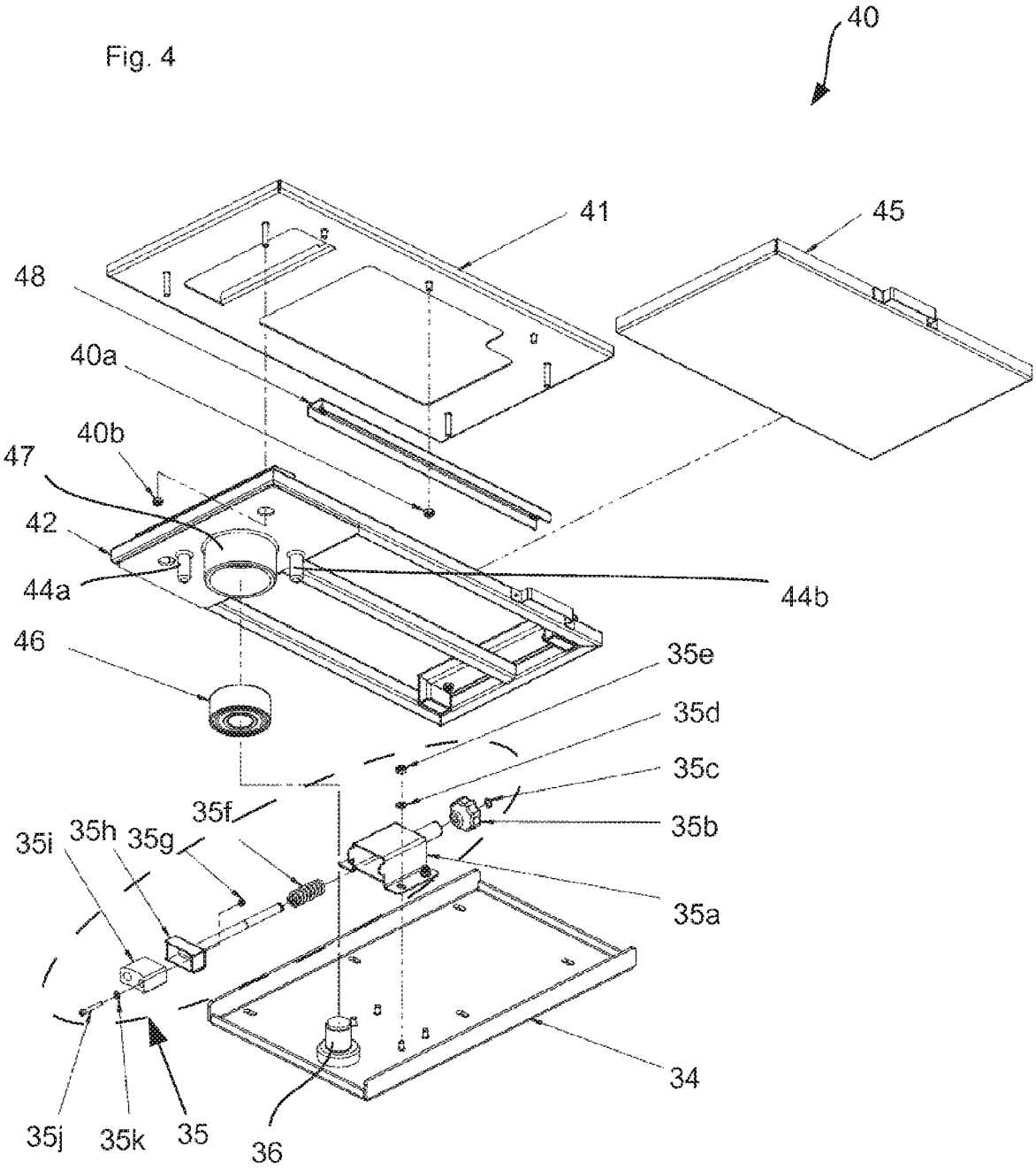
FIG. 4 shows an exploded view of the rotatable table of a printer module in a retracted position.
Figure 5:
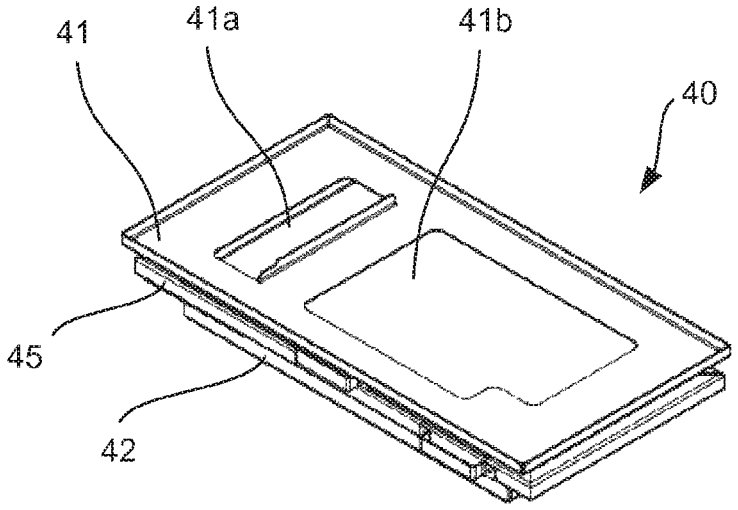
FIG. 5 shows the rotatable table of FIG. 4 in a composed state.

As shown in FIG. 3, the cabinet configuration 1 may also comprise other configurations. In particular, either the electric module 20 or the printer module 30 may be omitted. Due to the modular structure, the Cabinet configuration 1 can be adjusted according to the corresponding requirements.

The base module 10 which provides a basis for the cabinet configuration 1 is located at a lower side thereof. The base module 10 comprises a base body 11, which is a supporting structure.

According to the present embodiment, four feet 12 are located at a lower end of the base module 10. Each foot 12 comprises a post 12*a* (cylindrical element) and a stabilizer foot 12*b* (duck foot). The post 12*a* comprises an external thread and the stabilizer foot 12*b* comprises an internal thread, the external thread of the post 12*a* and the internal thread of the stabilizer foot 12*b* engaging with each other.

The stabilizer foot 12*b* can be adjusted in height, and, due to an increased area at the tip end portion thereof, the cabinet configuration 1 can be securely arranged by turning the tip end portion of the stabilizer feet 12 facing away from the base module 10.

The cabinet configuration 1 further comprises an electric module 20. The electric module 20 comprises a housing 21 and a front door 22. The electric module 20 may accommodate a programmable logic controller (PLC).

According to the present embodiments, the front doors 22, 32 may be turned separately. According to another modification, the front doors 22, 32 may be moved in conjunction.

The front door 22 and/or the front door 32 can be opened with smart service mobile phone.

Figure 2:
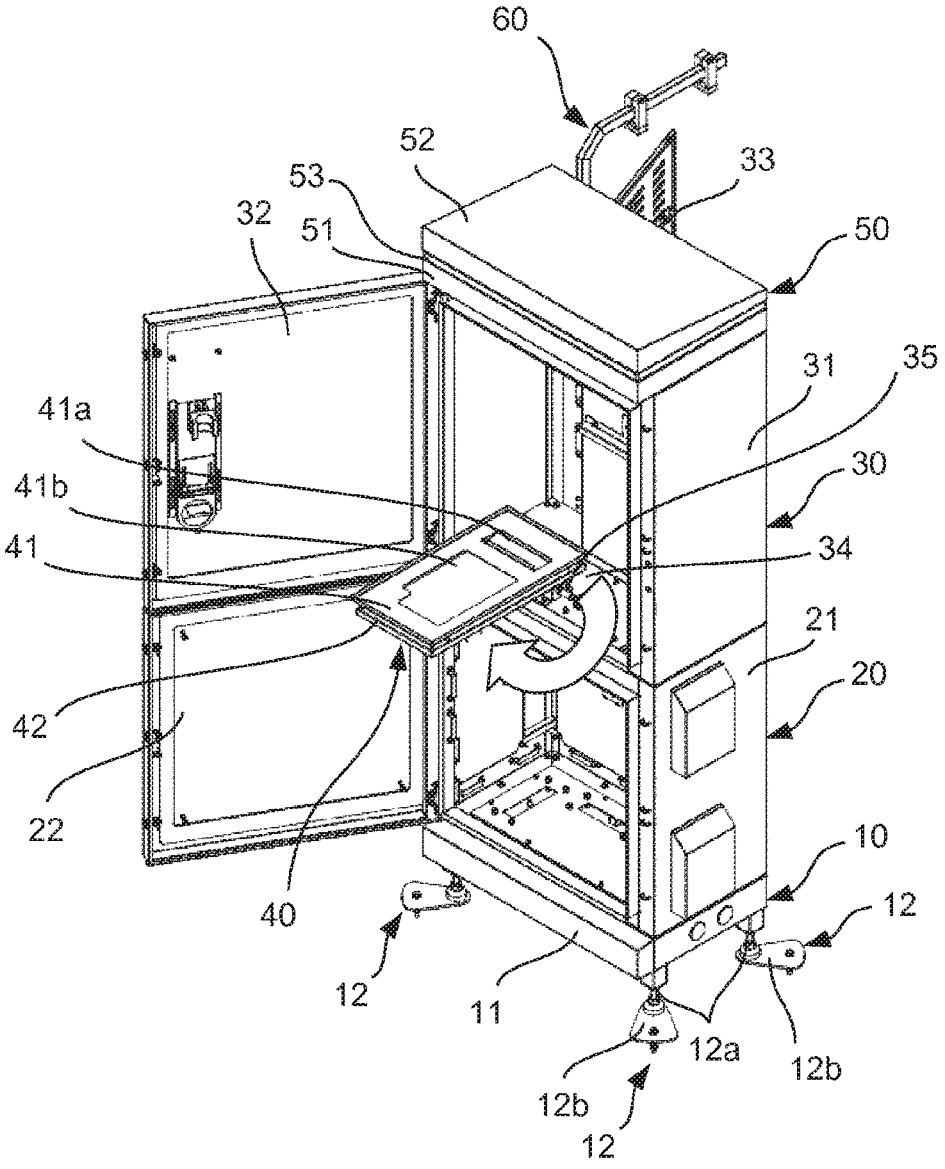
FIG. 2 refers to the cabinet configuration shown in FIG. 1 with opened doors.

According to the configuration as shown in FIGS. 1-2, the printer module 30 is placed on top of the electric module 20. The printer module 30 comprises a printer casing 31, a front door 22 and a back door 33. A front door 32 of the printer module 30 may be turned around an axis which coincides or substantially coincides with the axis of the front door 22 of the electric module 20.

The printer module 30, and in particular the printer casing 31, is suitable for accommodating a printer/printing device therein. The printing device is configured to provide markings, for example a text, an image, a barcode, or the like, on containers moved by the conveyor. Specific examples of such containers are bottles, boxes or parcels.

The back of the casing 31 is designed to accommodate fans and a duct for printer cables. Further, a pneumatic air cooler may be disposed in the casing 31. For having an enhanced airflow the fans, there one or more windows are installed in the lower part of the rear side of the casing 31 (not shown). Upper windows are closed with filters and are to exit of the air.

The printer module 30, or the printer casing 31, comprises a bottom portion 34. The bottom portion 34 may be an integrated part of the printer casing 31 or a separate element attached to another portion of the printer casing 31.

According to the present embodiment, a brake element 35 is attached to the bottom portion 34, which brake element 35 is configured to control the level of effort for turning a rotatable table 40.

A bushing/bearing 46 is mounted/introduced in a holding member 47 attached on a lower portion of the rotatable table (support element) 40. The holding member 47 is formed as a tube, the bushing 46 being introduced into the tube-shaped holding member 47. As will be explained in further detail below, the bushing 46 allows a rotational movement of the rotatable table 40, wherein the rotational movement, in particular the effort for moving the rotatable table 40, can be adjusted or limited via the brake element 35.

The brake element 35 comprises a box 35*a*, which is attached to the bottom portion 34 via nuts 35*e* mounted to corresponding pins of the bottom portion 34. A shim 35*d* is provided between the nut 35*e* and the pin of the bottom portion 34.

The brake element 35 further comprises an adjusting device 35*b*, which is in the present case a turnable wheel secured by a retaining ring 35*c*. The adjusting device 35*b* engages with a holder 35*h*, in particular with an external thread provided on a shaft of the holder 35*h*, so as to adjust a position of the holder 35*h* relatively to the box 35*a* or the bottom portion 34. A coil spring 35*f* is provided on the shaft of the holder 35*h*.

The holder 35*h* comprises a mounting portion, whereto a brake 35*i* is attached via bolts 35*j*, corresponding shims 35*k* and corresponding nuts 35*g*. In the present case, two bolts 35*j* extend through the brake 35*i* and the bolts 35*j* are fixed on the opposite side of the brake 35*i* via the nuts 35*g*.

The position of the holder 35*h* with the brake 35*i* is adjustable by the adjusting device 35*b* by moving the holder 35*h* against the force provided by the coil spring 35*f*.

The brake element 35, and in particular the brake 35*i* thereof, can be used for limiting a rotational movement of a rotatable table 40 relatively to the bottom portion 34, in particular by pressing the brake 35*i* against a holding member 47 provided on the lower portion 42 of the rotatable table 40. The rotatable table 40 (support element) is pivotably provided in the printer casing 31. The rotatable table 40 comprises an upper portion 41 and a lower portion 42, which are arranged with a gap therebetween.

In the present embodiment, the upper portion 41 comprises pins which are introduced into corresponding openings provided in the lower portion 42. Nuts 40*a*, 40*b* are used for fixing the lower portion 42 to the upper portion 41. In other modifications, different fixing members may be used for attaching the upper portion 41 and the lower portion 42 with a gap therebetween.

A shaft 36 is attached to the bottom portion 34, which shaft 36 is introduced into the bushing 46, the bushing being firmly attached to a holding member 47 of the lower portion 42. Consequently, the rotatable table 40 may be turned around the bushing 46 in a substantially horizontal plane. The brake element 35 may limit the rotational movement of the rotatable table 40.

Since the shaft 36 is located at an eccentric position of the bottom portion 34, the rotational movement of the rotatable table 40 can be used for extracting and retracting the rotatable table 40 from and to the printer casing 31.

So as to restrict the rotational movement of the rotatable table 40, a first pin 44*a* and a second pin 44*b* are provided on the lower portion 42 of the rotatable table 40. The pins 44*a*, 44*b* represent stop elements which limit the rotational movement of the rotatable table 40 at the extracted position (see FIG. 2) and the retracted position (when the rotatable table 40 is arranged within the printer casing 31).

The upper portion 41 of the rotatable table 40 comprises a first and second retaining portion 41*a*, 41*b* for attaching and/or retaining a printing device on the rotatable table 40, respectively. The retaining portions 41*a*, 41*b* are configured to stabilize the position of the printer on the upper portion. The retaining portions 41*a*, 41*b* can be adapted to the dimensions of a specific printer. Since the present embodiment refers to an upper section 41 having two retaining portions 41*a*, 41*b*, two printing devices may be disposed on the rotatable table 40.

In the gap between the upper portion 41 and the lower portion 42, a tray 45 is provided. The tray 45 is used to support a hydraulic system during maintenance, and the tray 45 is designed so that leaking ink may be retained. The tray 45 may be moved relatively to the upper and lower portion 41, 42 so as to extract the tray 45 from the gap between the upper portion 41 and the lower portion 42 of the rotatable table 40.

A stopper 48, which is, according to the present embodiment, a longitudinal member, is provided between the upper portion 41 and the lower portion 42. When the tray 45 is introduced into the gap between the upper portion 41 and the lower portion 42, the tray 45 may be moved against the stopper 48.

The top cover module 50 comprises a lower cover body 51, an upper cover body 52 and a light element 53 (light strip) disposed therebetween. The light element 53 is composed of a transparent or semitransparent element, preferably of acrylic or glass material, that is arranged in between of the lower or upper cover body 51, 52. LEDs are disposed on a portion of the transparent or semitransparent element. The LEDs provide light and, according to a preferred embodiment, the colors of the light may change (for example green, yellow and red).

The arm extensor 60 attached to a rear side of the printer module 30 is used for guiding a printer cable and to support and direct the printer power wiring a pneumatic power to a peripheral device or to a production line adjacent to the cabinet configuration 1. The production line may comprise a conveying device for conveying objects like containers, packages, products, parcels or bottles.

The invention claimed is:

1. A cabinet configuration for accommodating at least one printing device for marking objects like containers, packages, products, parcels or bottles, the cabinet configuration comprising:

a printer module with a casing, the casing comprising an opening for introducing and extracting the printing device, a support element for supporting the printing device is-movably connected to an inner portion of the casing, so that the support element is at least partially extractable from the casing, wherein the support element comprises an upper portion and a lower portion, the upper portion and the lower portion being spaced apart with a gap therebetween, and a tray is provided in the gap between the upper portion and the lower portion, the tray being configured to retain ink leaking from the printing device and being at least partially extractable from the gap.

2. The cabinet configuration according to claim 1, wherein the support element is rotatable relative to the casing.

3. The cabinet configuration according to claim 1, wherein a shaft supports the support element, the shaft being in engagement with a bushing of the support element.

4. The cabinet configuration according to claim 1, wherein the printer module comprises a door for opening and closing the opening of the casing.

5. The cabinet configuration according to claim 1, further comprising an electric module mountable on an upper or lower side of the printer module, the electric module having a housing for accommodating a programmable logic controller.

6. The cabinet configuration according to claim 1, further comprising a top cover module mountable on an upper portion of the printer module, the top cover module comprising a light element at least partially surrounding the top cover module.

7. The cabinet configuration according to claim 6, wherein the top cover module comprises a lower cover body and an upper cover body, the light element being disposed at or in a groove formed by the lower or upper cover body.

8. The cabinet configuration according to claim 6, wherein the light element comprises a LED element.

9. The cabinet configuration according to claim 1, further comprising a base module, the base module comprising feet including a post and a stabilizer foot, respectively.

10. The cabinet configuration according to claim 9, wherein the post and the stabilizer foot are engaged with each other by an external thread and an internal thread.

11. The cabinet configuration according to claim 9, further comprising a brake element configured to control the level of effort for turning; the support element.

12. The cabinet configuration according to claim 1, wherein the support element comprises a first and second retaining portion for retaining and arranging a printing device, respectively.

13. The cabinet configuration according to claim 1, wherein the support element is movably connected to a bottom portion of the casing.

14. The cabinet configuration according to claim 2, wherein the support element is rotatable around a vertical axis.

15. The cabinet configuration according to claim 3, wherein the bushing is eccentrically arranged on the support element.

16. The cabinet configuration according to claim 4, wherein the door is movable around a vertical axis.

17. The cabinet configuration according to claim 8, wherein the LED element is configured to provide different colors.

18. The cabinet configuration according to claim 9, wherein the stabilizer foot is eccentrically mounted to the post and rotatable relatively to the post.

19. A method for handling a printing device, the printing device being supported by a support element, the support element being located in a casing of a cabinet configuration and comprising an upper portion and a lower portion, the upper portion and the lower portion being spaced apart with a gap therebetween, where a tray is provided, the tray being configured to retain ink leaking from the printing device and being at least partially extractable from the gap, the method comprising the following steps:

extracting at least a portion of the support element from the casing by turning the support element, performing a maintenance operation to the printing device.

20. The method for handling a printing device according to claim 19, wherein the at least a portion of the support element is extracted from the casing by turning the support element around a vertical axis.

* * * * *